United States Patent [19]

Lüttgens

[11] Patent Number: 4,620,558

[45] Date of Patent: Nov. 4, 1986

[54] DEVICE FOR SHAVING JACKETED STICKS

[75] Inventor: Werner Lüttgens, Erlangen, Fed. Rep. of Germany

[73] Assignee: A. Klebes GmbH & Co. KG Kunststoff- und Metallwarenfabrik, Erlangen, Fed. Rep. of Germany

[21] Appl. No.: 464,026

[22] Filed: Feb. 4, 1983

[30] Foreign Application Priority Data

Feb. 12, 1982 [DE] Fed. Rep. of Germany ..... 3204927

[51] Int. Cl.[4] ..... A45D 40/00

[52] U.S. Cl. ..... 132/79 R

[58] Field of Search ..... 132/85, 80, 88.5, 79; 30/454, 451

[56] References Cited

U.S. PATENT DOCUMENTS

| | | | |
|---|---|---|---|
| 1,306,903 | 6/1919 | Imaizumi | 30/451 |
| 1,598,365 | 8/1926 | Clarke | 132/79 R |
| 2,570,596 | 10/1951 | Ross | 132/79 R |
| 2,796,070 | 6/1957 | Marsak | 132/85 |
| 3,277,901 | 10/1966 | McElhiney | 132/80 R |
| 3,630,211 | 12/1971 | Seidler | 132/88.5 |
| 4,248,283 | 2/1981 | Kaye | 30/454 |
| 4,281,698 | 8/1981 | Mobius | 30/454 |
| 4,402,354 | 9/1983 | Halpern | 30/454 |

*Primary Examiner*—Gregory E. McNeill
*Attorney, Agent, or Firm*—Spencer & Frank

[57] ABSTRACT

A device for shaving jacketed sticks comprises a housing block, a shaving knife supported in the housing block, an orifice in the housing block for introducing a jacketed stick and bringing it in contact with the shaving knife, first and second chambers in the housing block for receiving, respectively, jacket shavings and material removed from the stick; and a septum separating the first and second receiving chambers from one another.

18 Claims, 11 Drawing Figures

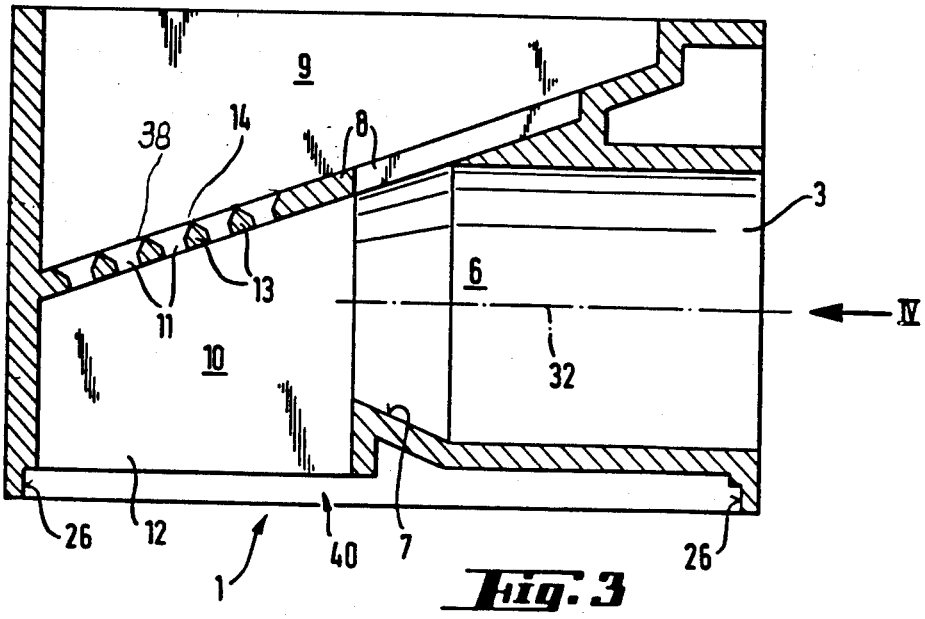
Fig. 3
Fig. 2
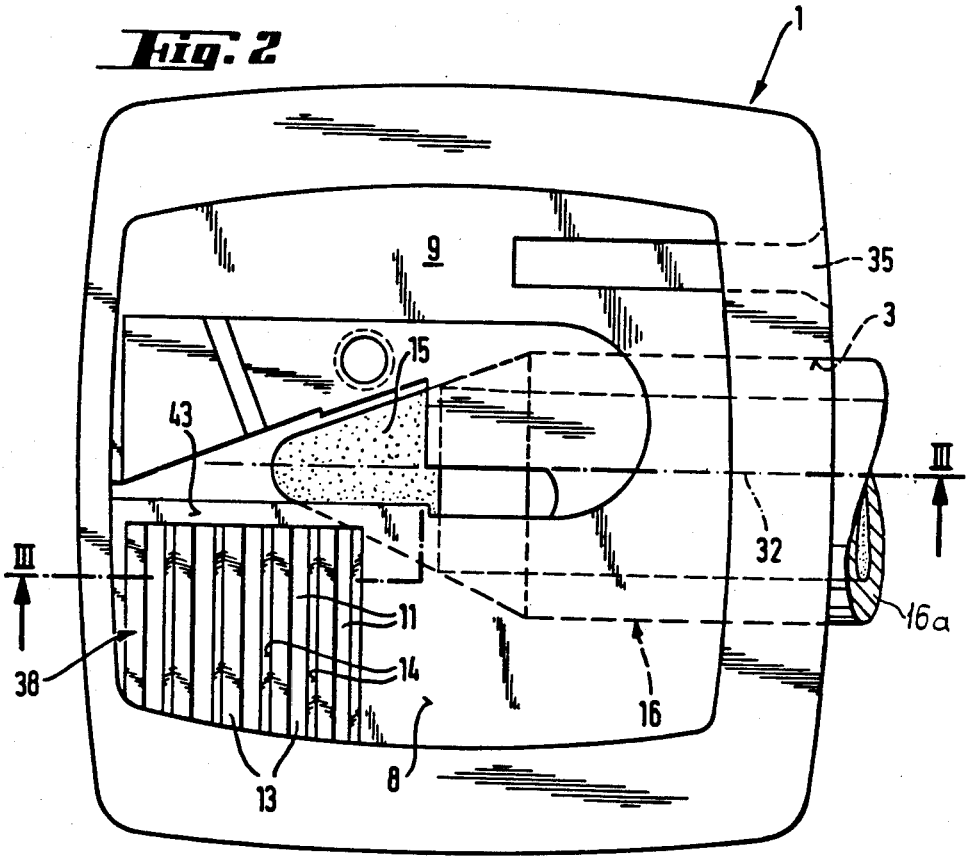

DEVICE FOR SHAVING JACKETED STICKS

BACKGROUND OF THE INVENTION

This invention relates to a shaving device for removing parts of a jacket made, for example, of wood, to expose the end of an embedded stick formed of consumable matter. The device includes a shaving knife and a receptacle which is closable by a removable top lid and which has the purpose of receiving the shavings.

It has recently been suggested by the cosmetics industry to provide powder in stick form and to surround the stick with a shavable jacket. The shavable jacket is intended to facilitate handling without the risk of soiling and to stabilize the powder stick.

SUMMARY OF THE INVENTION

It is an object of the invention to provide a shaving device of the above-outlined type which is adapted particularly for the shaving of powder stick assemblies, independently of whether the powder is of powdery or slightly creamy consistency.

This object and others to become apparent as the specification progresses, are accomplished by the invention, according to which, briefly stated, the shaving device comprises two separate receptacles (receiving chambers) for receiving the powder and jacket shavings, respectively.

According to the invention as outlined above, the powder removed from the stick is readily separated from the shavings from the stick jacket and thus may be utilized for cosmetic purposes with the aid of an applicator.

According to a further feature of the invention, the two receiving chambers are separated from one another by a septum which is coplanar or parallel with the plane of the shaving knife in the zone thereof. According to this feature, the shaving knife constitutes a substantial part of the septum between the two receiving chambers.

According to a further feature of the invention, the receiving chamber for the powder is below and the receiving chamber for the jacket shavings is above the shaving knife, as viewed in the orientation of the shaving device during use. This feature is based on the recognition that during shaving the device is normally held in such a manner that the shaving operation can be monitored visually. For this purpose, numerous shaving devices are made of a transparent synthetic material. According to the invention, the shavings removed from the jacket are introduced into the receiving chamber situated above the knife, whereas the powder, because of its consistency and weight, drops into the receiving chamber situated underneath the shaving knife.

According to still another feature of the invention, the base of the device is formed by a releasable bottom lid in order to facilitate removal of the powder from the receiving chamber.

According to a further feature of the invention, in the septum between the two receiving chambers a connecting opening is provided, whose passage is traversed by a screen. This feature prevents small particles of the jacket shavings from passing into the receiving chamber for the powder.

The orifice provided in the shaving device for the introduction of the powder stick continues in a guide cone which is effective only in the zone of the stick jacket. If the guide cone were effective also in the zone of the powder stick itself, then the torsion forces exerted by the conical guide during shaving would immediately shear off portions of the powder stick. Thus, since during the shaving, the powder removed by the shaving knife is outside the range of the guide cone, according to a further feature of the invention the connecting opening provided in the septum between the receiving chambers is situated externally of the guide cone and, in particular, it adjoins the guide cone in the direction of the stick feed during the shaving operation.

According to another feature of the invention, the connecting opening adjoins that boundary of the shaving slot which is opposite the shaving knife. This feature is advantageous in that the position of the connecting opening prevents an accumulation of powder in the receiving chamber designed for the jacket shavings.

According to another feature of the invention, the width of the shaving slot is just sufficient to allow the jacket shavings to pass into the receiving chamber during the shaving operation. This feature prevents the penetration of the jacket shavings into the receiving chamber for the powder underneath the shaving knife.

According to still another feature of the invention, the upper face of the screen mounted in the connecting opening is designed as an abrading surface. By virtue of this feature the screen, when the top lid is removed, may be used for shaping the powder stick. During such an operation, the abraded powder directly falls into the powder receiving chamber through the screen. Advantageously, the screen has a configuration which corresponds to the desired shape of the powder stick. Advantageously, there are provided two abrading surfaces arranged at an angle to one another.

According to a further feature of the invention, the upper face of the screen is at an acute angle to the plane of the shaving knife, the angle pointing towards that side of the shaving device where the stick is introduced. This feature provides that the abrading face of the screen may be visually monitored from the outside. Also, this feature further aids in better adapting the shape of the abrading face to the usually desired contour of the powder stick. In order to nevertheless maintain an earlier-mentioned feature, namely, that the shaving slot is designed to have a width just sufficient to allow the jacket shavings to pass therethrough and into the receiving chamber, the intermediate space between the lateral edge of the screen and the shaving slot is closed by an intermediate wall which may be formed by finger-like laminae which function as a screen and which also have the role of separating the two receiving chambers from one another.

According to a further feature of the invention, the bottom lid of the shaving device has at its inside a concave, dish-like configuration. This feature provides that the powder removed from the powder stick is immediately collected in the bottom lid which thus acts as a receptacle. Upon removal of the bottom lid, the powder therein is readily available for further use.

According to a further feature of the invention, the connecting opening between the two receiving chambers may be blocked at will. This feature is advantageous in that it permits carrying the device, for example, in purses while powder and/or jacket shavings are already present in the receiving chambers, without risking that powder or jacket shavings penetrate into a receiving chamber not intended for them. Similar effect is achieved by a further feature of the invention, according to which the bottom lid may be attached to the shaving device in at least two different angular positions related to an axis perpendicular to the bottom lid. In one of the positions, a lid projection blocks the connecting opening or, as the case may be, a coupling channel communicating therewith. Thus, dependent upon the angular position of the mounted bottom lid, the connecting opening between the two receiving chambers is either open or closed.

According to another feature of the invention, the bottom lid may be attached to the shaving device in n+1 different angular positions. Further, the bottom lid has, at its inner face, n depressions which may be selectively aligned with the connecting opening or with a coupling channel communicating therewith. This feature is based on the consideration that often the user of cosmetic products needs several powder sticks of different colors. The feature outlined above thus makes possible to render effective, for each powder stick, one particular receptacle in the bottom lid of the device so that as powder sticks of different color are shaved with the device, the different powders do not mix in the receiving chamber but remain separated for further use.

According to a further feature of the invention, the underside of the device housing may be covered at least in part by a closure plate which has a passage that is aligned with the connecting opening provided in the septum between the two receiving chambers or with a coupling channel communicating with the connecting opening. This feature takes into account the fact that the conventionally injection-molded, one-piece housings have, as a result of the molding process, fissures at their underside. Since the underside of the device housing is, according to the invention, a component of the receiving chamber for the powder removed from the stick during the shaving operation, the likelihood of substantial soiling of the fissured underside of the housing has to be taken into consideration. The outlined feature prevents such an occurrence. According to further related features of the invention, the closure plate is of a soft-elastic synthetic material and further, when the bottom lid is in place, an annular collar around the passage in the closure plate sealingly surrounds the passage-blocking elevation provided in the bottom lid. Also, in the attached state of the bottom lid, the closure plate sealingly engages the edge regions of each depression (receptacle) in the bottom lid and in particular, form-fittingly surrounds the same by means of grooves. These features all serve for providing a hermetic seal of the connecting opening and the individual depressions (receptacles) in the bottom lid.

In accordance with still another feature of the invention, the bottom lid is, in the removed state, closable by a cap, particularly by the top lid of the receiving chamber for the jacket shavings or by the closure plate for the housing. This feature provides that the bottom lid may be separated from the device housing after the shaving operation and may be used as a miniature powder box (compact) in purses. Since thus the cap for the bottom lid (when used as a miniature compact) may be a removable component of the shaving device, no additional component which does not belong to the device is needed to cover the bottom lid.

According to a further feature of the invention, the closure plate may be inserted onto the underside of the device housing. This feature makes possible a simple removal of the closure plate, for example, for use as a cap for the earlier-noted miniature compact.

According to a further feature of the invention, the closing cap, in the installed state, sealingly separates from one another the depressions (dishes) of the bottom lid. This feature makes it possible to remove the closure plate together with the bottom lid in one movement. This arrangement ensures that no powder can be spilled from the bottom lid even if the latter is violently jarred during removal.

According to a further feature of the invention, the orifice of the device through which the powder stick assembly is introduced for performing thereon the shaving operation, is provided with a removable plug. That end of the plug which is oriented towards the inside of the device housing carries a powder applicator such as a brush. This applicator is particularly adapted for using the powder received in the bottom lid. Thus, no particular space has to be provided to accommodate such applicator and also, risks of soiling are practically eliminated. Substantially the same purpose is served by another feature of the invention, according to which a brush is provided which may be inserted from the outside into the receiving chamber and seals the orifice of the device or may be inserted into a clamping arrangement in the receiving chamber for the jacket shavings.

In summary, by virtue of the invention the large-volume shavings from the powder stick jacket may be introduced into a separate receiving chamber, whose inlet does not need to be protected by special measures, because the powder that may potentially cause soiling is collected in a separate receiving chamber. The cleaning and emptying of the receiving chamber for the jacket shavings may be performed easily and frequently, and without the risk of soiling. The bottom lid is removed only for particular purposes such as for a touch-up powdering or for changing the angular position of the bottom lid when a powder stick of another color is being shaved or for blocking the connecting opening in the septum separating the two receiving chambers.

BRIEF DESCRIPTION OF THE DRAWINGS

FIG. 2 is a top plan view of a component seen in a direction substantially parallel to arrows II—II of FIG. 1*a*.

FIG. 3 is a sectional view taken along lines III—III of FIG. 2.

DESCRIPTION OF THE PREFERRED EMBODIMENTS

Figures 1A, 1B:
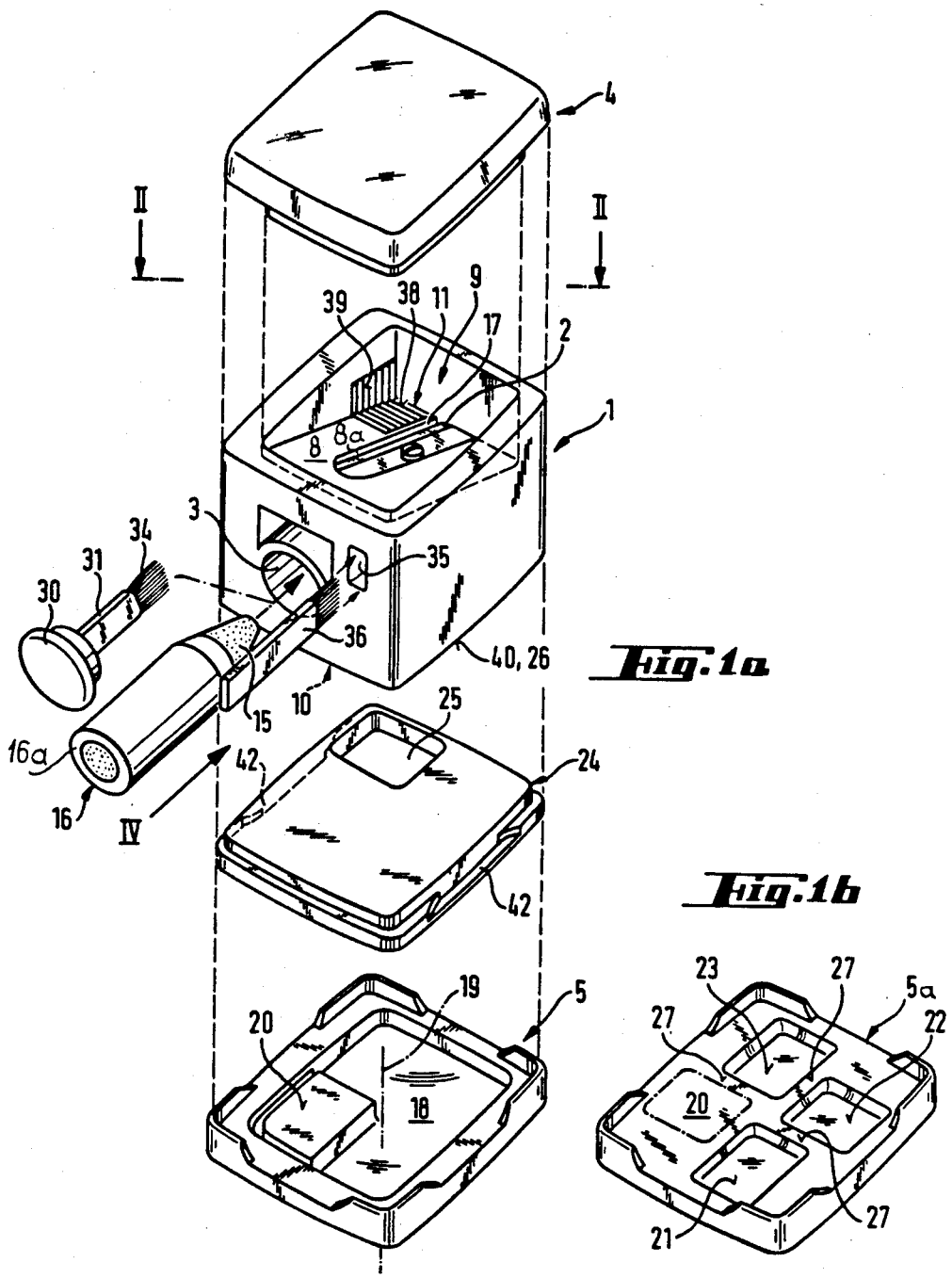
FIG. 1*a* is a perspective exploded view of a preferred embodiment of the invention.
FIG. 1*b* is a perspective view of a component according to another preferred embodiment of the invention.

Turning to FIGS. 1*a*, 2 and 3, the device shown therein has a housing block 1 in which there is mounted a shaving knife 2 and which further has an orifice 3 for the introduction of a stick assembly 16 to be shaved, as well as manually removable top and bottom lids 4 and 5, respectively. The stick assembly 16 is formed of a powder stick 15 and a jacket 16*a* made, for example, of wood.

The housing block 1 in essence constitutes a conventional stick shaving device which has, as shown in FIG. 3, a guiding channel 6 adjoining the insert orifice 3 in the direction of introduction and is provided with a short, terminal guide cone 7 according to the relatively small thickness of the jacket 16*a* of the powder stick assembly 16.

According to the invention, the housing block 1 has a separating wall or septum 8 which is provided in the zone of the shaving knife 2 and which extends coplanar or parallel therewith. The septum 8 separates two receiving chambers 9 and 10 from one another. The upper receiving chamber 9 is intended to receive shavings from the jacket 16*a* of the powder stick assembly 16, whereas the lower chamber 10 is intended to receive powder removed from the powder stick 15. The base of the receiving chamber 10 is formed by the manually removable bottom lid 5.

In the septum 8 a connecting opening 11 is provided which is adjoined by a coupling channel 12. The connecting opening 11 is traversed by parallel filing bars 13 which, at their side oriented towards the receiving chamber 9, form a rasping edge 14. The filing bars 13 constitute a screen 38 with an abrading surface in the connecting opening 11, preventing jacket shavings from passing into the coupling channel 12 from the receiving chamber 9. The rasping edges 14 make possible a shaping of the powder stick 15 of the powder stick assembly 16. The connecting opening 11 is situated externally of the guide cone 7 in the housing block 1 and approximately adjoins the guide cone 7 in the direction of stick feed. The cutting edge of the shaving knife 2 and an edge 8*a* of the septum 8 together define a very narrow shaving slot 17. The connecting opening 11 is arranged adjacent the septum edge 8*a*, that is, on that side of the shaving slot 17 which is opposite the shaving knife 2. A further abrading surface 39 may be provided on the side of the receiving chamber 9.

Figure 3A:
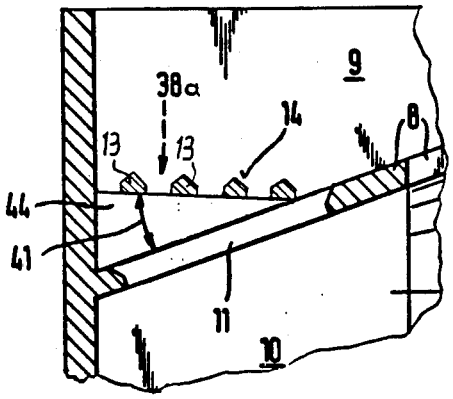
FIG. 3*a* is a fragmentary sectional view of the structure shown in FIG. 3, illustrating a variant.

In a variant illustrated in FIG. 3*a* there is shown an abrading screen 38*a* which is arranged at an acute angle 41 to the plane of the septum 8. Such an arrangement of the screen 38*a* facilitates the shaping of the stick on the rasping surface of the screen. The screen 38*a* has a boundary edge (which corresponds to the boundary edge 43 of the screen 38 shown in FIG. 2) from which extends a wall 44 downwardly into the zone of the shaving slot 17. The wall 44 aids in the positive separation of the two receiving chambers 9 and 10 from one another. It is noted that instead of the wall 44 laminae or the like may be used which, while permitting passage of powder into the receiving chamber 10, prevent passage of jacket shavings.

Figure 8:
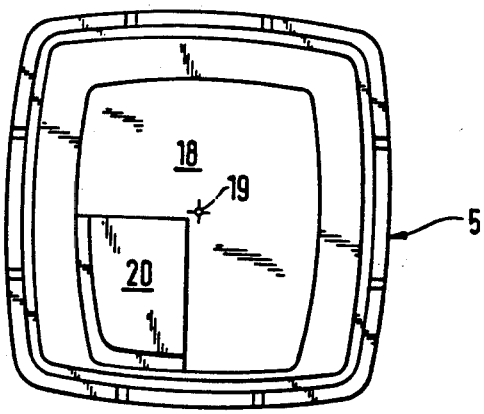
FIG. 8 is a top plan view of a component illustrated in FIG. 1*a*.

Turning once again to FIG. 1*a* and also referring to FIG. 8, the bottom lid 5 is depressed (concave) at its inner face 18. The housing block 1 has a substantially quadratic circumferential outline; the sides of the square may have a slightly outwardly convex course. This arrangement provides that the bottom lid 5 may be attached or inserted on the housing block 1 in four different angular positions with respect to an axis 19 which is generally perpendicular to the principal plane of the bottom lid 5. The inside face 18 of the bottom lid 5 is provided with a pedestal-like elevation 20 which occupies substantially an entire quadrant of the rectangular surface of the inside face 18. In one of the four possible positions of the bottom lid 5 on the housing block 1, the elevation 20 obturates the connecting opening 11 or, as the case may be, the coupling channel 12 of the housing block 1.

Turning now to FIG. 1*b*, there is shown a modified construction of the bottom lid, designated at 5*a*. The bottom lid 5*a* is provided on its inner face with three dish-like depressions 21, 22 and 23 which, in the different angular positions of the bottom lid 5*a* on the housing block 1, are selectively brought in alignment with the connecting opening 11 or, as the case may be, with the coupling channel 12.

Figure 4:
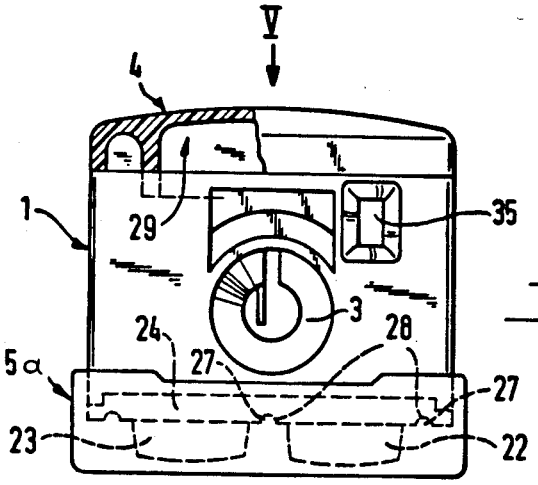
FIG. 4 is a partially sectional front elevational view—as seen in the direction of arrow IV of FIG. 3—of the preferred embodiment illustrated in FIG. 1*a*, but including the component shown in FIG. 1*b*.
Figure 6:
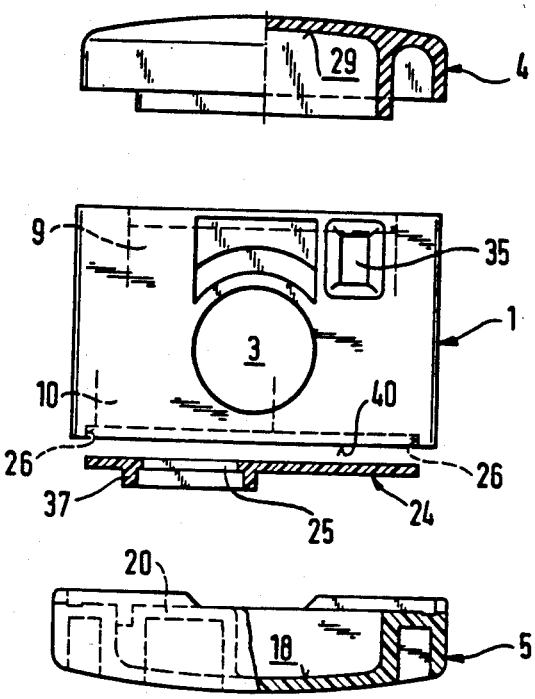
FIG. 6 is a partially sectional exploded front elevational view of some of the components illustrated in FIG. 1*a* as seen in the direction of arrow IV of FIG. 3.

Reverting once again to FIG. 1*a* and also referring to FIGS. 4 and 6, the underside 40 of the housing block 1 is closed off by a closure plate 24 which is of softly elastic material and which is provided with an opening 25 aligned with the connecting channel 12. The closure plate 24 may be inserted into and secured sealingly within an annular collar 26 forming the lower edge of the housing block 1. When the bottom lid 5 is in place, the opening 25 sealingly surrounds the elevation 20 in one of the possible angular positions of the bottom lid 5. If a bottom lid 5*a* is used in the angular positions in which the elevation 20 is out of registry with the opening 25 of the closure plate 24, the latter sealingly engages the circumferential rib-like boundaries 27 of the depressions (receptacles) 21, 22 and 23. For ensuring a reliable seal, the underside of the closure plate 24 is provided with grooves 28 into which the ribs 27 project, as illustrated in FIG. 4.

Figure 7:
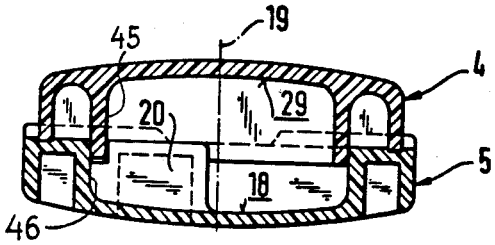
FIG. 7 is a sectional elevational view of two components normally forming part of the structure shown in FIG. 4, but illustrated in a directly interconnected relationship.

The bottom lid 5 is, in its removed state, closable by the top lid 4 of the receiving chamber 9 to thus form a miniature compact. Turning now to FIG. 7, the top and bottom lids 4 and 5 are so designed that the top lid 4 sealingly closes off the inner face 18 of the bottom lid 5 in the interengaging position. Thus, for this purpose, a rib or wall 45 of closed course extends from the inner face 29 of the top lid 4 parallel to the axis 19 and sealingly fits into a complemental wall 46 of the bottom lid 5. It will be understood that similar arrangements may be provided on the bottom lid 5*a* shown in FIGS. 1*b* and 4.

As seen in FIG. 1*a*, the closure plate 24 has two oppositely located lateral edges provided with cutouts 42 to render those edges manually accessible when the closure plate 24 is in its mounted state on the housing block 1. By virtue of the cutouts 42, the exposed edges of the closure plate 24 may be engaged by the user's fingers and thus the closure plate 24 may be manually removed from the housing block 1, together with the attached bottom lid 5.

In case a bottom lid 5*a* having a plurality of depressions 21, 22 and 23 is used, the closure plate, by virtue of the grooves 28 provided in its underside, receives the ribs 27 of the bottom lid 5*a*, thus securely separating the depressions 21, 22 and 23 from one another.

Figure 5:
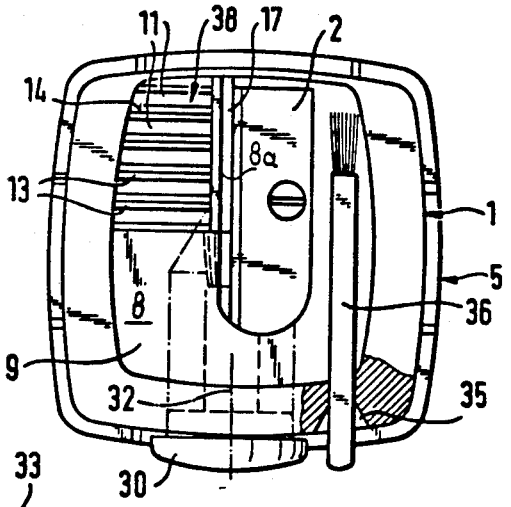
FIG. 5 is a top plan view—as seen in the direction of arrow V of FIG. 4—of the components shown in FIG. 4 with the top lid removed.
Figure 5A:
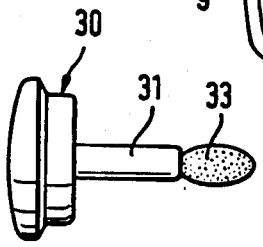
FIG. 5*a* is an elevational view of a variant of a component forming a removable part of the structure shown in FIG. 1*a*.

When the device is not in use, the orifice 3 of the housing block 1 may be blocked by a plug 30 (FIGS. 1*a* and 5) which carries a stem 31 on its face oriented towards the inside of the housing block 1. The stem 31 extends coaxially with the guiding channel 6 and carries at its end a small powder applicator sponge 33 (FIG. 5*a*) or a brush 34 (FIG. 1*a*). Further, the housing block 1 may be provided with a storage opening 35 into which a cleaning brush 36 may be inserted, as shown in FIGS. 1*a* and 5.

In the description which follows, the operation of the shaving device according to the invention will be set forth.

During the shaving operation, jacket shavings of the powder stick assembly 16 are introduced through the shaving slot 17 into the receiving chamber 9 while powder shaved or abraded from the powder stick falls through the shaving slot 17 or through the connecting opening 11 and the coupling channel 12 into the dished inner face 18 of the bottom lid 5 and accumulates there. After the shaving operation is completed, the bottom lid 5 is removed and rotated about the axis 19 in such a manner that the elevation 20 registers with the opening 25 of the closure plate 24 and thus blocks the same. In this position an annular collar 37 (FIG. 6) forming part of the closure plate 24 and arranged about the opening 25, sealingly surrounds the elevation 20. In this manner, the inner space 18 of the bottom lid 5 is hermetically separated from the receiving chamber 9 of the shaving device. Thereafter, without risk of soiling, the top lid 4 may be taken off and the shavings in the receiving chamber 9 may be removed, for example, by inverting the housing block 1.

In case another powder stick, for example, of a different color is to be shaved, only the bottom lid 5 is taken off and reinstalled with an appropriate rotation about the axis 19 such that another dish-like receptacle 21, 22 or 23 is brought into registry with the connecting channel 12 so that the abraded powder from the new, second stick drops into another one of the dishes 21, 22 or 23.

It will be understood that the above description of the present invention is susceptible to various modifications, changes and adaptations, and the same are intended to be comprehended within the meaning and range of equivalents of the appended claims.

What is claimed is:

1. A device for shaving jacketed sticks comprising (a) a housing block;

(b) a shaving knife supported in the housing block;

(c) means defining an orifice in said housing block for introducing a jacketed stick and bringing it in contact with said shaving knife;

(d) first and second chambers in said housing block for receiving, respectively, jacket shavings and material removed from the stick;

(e) a septum in said housing block; said septum separating said first and second receiving chambers from one another;

(f) a connecting opening in said septum connecting said first and second receiving chambers with one another; and (g) a screen traversing said connecting opening; said screen preventing shavings from passing from said first receiving chamber through said connecting opening into said second receiving chamber.

2. A device as defined in claim 1, wherein said shaving knife has a first side and a second side reverse from said first side; said first receiving chamber being on said first side and said second receiving chamber and said orifice being on said second side of said shaving knife.

3. A device as defined in claim 1, wherein said septum is parallel with said shaving knife in the zone thereof.

4. A device as defined in claim 1, further comprising a removable plug insertable in said orifice; further comprising a powder applicator mounted on said plug; said powder applicator being accommodated in said orifice when said plug is in an inserted state in said orifice.

5. A device as defined in claim 1, wherein said rasping face has two rasping face portions being inclined to one another.

6. A device as defined in claim 1, further comprising (h) a manually removable top lid normally fastened to said housing block; said top lid forming an upper bounding wall of said first chamber; said first chamber being freely exposed to the environment when said top lid is absent from said housing block; and (i) a manually removable bottom lid normally fastened to said housing block and forming a base of said device.

7. A device as defined in claim 6, wherein said bottom lid has a depressed inner face oriented towards said housing block when said bottom lid is in an attached state on said housing block.

8. A device as defined in claim 6, wherein said manually removable top and bottom lids comprise complemental means for directly securing said top lid as a closure to said bottom lid.

9. A device as defined in claim 1, further comprising a guide cone in said housing block; said guide cone being in alignment with said orifice for receiving a leading end of said stick assembly when introduced in said orifice; said connecting opening being situated externally of said guide cone.

10. A device as defined in claim 1, further wherein said screen has a rasping face oriented towards said first receiving chamber, whereby material removed from the stick by said rasping face upon rubbing said stick thereagainst drops from said rasping face through said screen into said second receiving chamber.

11. A device as defined in claim 10, wherein said rasping face of said screen is at an acute angle with respect to a plane in which said shaving knife lies; said acute angle having a point oriented towards said orifice.

12. A device as defined in claim 1, wherein said shaving knife has a cutting edge and said septum has a bounding edge; said cutting edge and said bounding edge extending parallel to and spaced from one another and together defining a shaving slot; said connecting opening being situated adjacent said bounding edge and remote from said cutting edge.

13. A device as defined in claim 12, wherein said shaving slot has a width dimension just sufficiently large to allow shavings from the jacket of said jacketed stick assembly to pass into said first receiving chamber.

14. A device as defined in claim 1, further comprising a manually removable bottom lid normally fastened to said housing block and forming a base of said device, said bottom lid having (a) an inner face oriented towards said housing block when said bottom lid is in an attached state on said housing block; said inner face including a depression forming a receptacle for receiving material falling through said connecting opening;

(b) an axis generally perpendicular to said bottom lid;

(c) an elevation rising from said inner face and being arranged eccentrically with respect to said axis; and (d) means for selectively attaching said bottom lid to said housing block in a plurality of angular positions related to said axis; in one of said angular positions said elevation blocking communication between said connecting opening and said receptacle.

15. A device as defined in claim 14, further comprising a manually removable closure plate normally fastened to said housing block between an underside of said housing block and said bottom lid, said closure plate having an aperture in communication with said connecting opening, said aperture being sealingly blocked by said elevation of said bottom lid in one of the angular positions for blocking communication between said connecting opening and said receptacle.

16. A device as defined in claim 15, wherein said inner face of said bottom lid has a predetermined number of depressions each forming a separate receptacle; and further wherein the number of said plurality of angular positions equals said predetermined number increased by one; any selected one of said separate receptacles being arranged in registry with said connecting opening in a selected one of said angular positions; said closure plate and said bottom lid comprising complemental sealing means for separately sealing each said receptacle in an attached state of said bottom lid on said housing block.

17. A device as defined in claim 14, wherein said inner face of said bottom lid has a predetermined number of depressions each forming a separate receptacle; and further wherein the number of said plurality of angular positions equals said predetermined number increased by one; any selected one of said separate receptacles being arranged in registry with said connecting opening in a selected one of said angular positions.

18. A device as defined in claim 17, further comprising a manually removable top lid normally fastened to said housing block; said top lid forming an upper bounding wall of said first chamber; said first chamber being freely exposed to the environment when said top lid is absent from said housing block; further wherein said manually removable top and bottom lids comprise complemental means for directly securing said top lid as a closure to said bottom lid and further wherein said manually removable top and bottom lids comprise complemental sealing means for separately sealing each said receptacle when said top and bottom lids are directly attached to one another.

* * * * *